US009033487B2

(12) United States Patent
LeFevre et al.

(10) Patent No.: US 9,033,487 B2
(45) Date of Patent: May 19, 2015

(54) DEVICE AND METHOD FOR ADDRESSABLE SPRAY-ON APPLICATION OF RELEASE AGENT TO CONTINUOUS FEED MEDIA

(71) Applicant: Xerox Corporation, Norwalk, CT (US)

(72) Inventors: Jason M. LeFevre, Penfield, NY (US); James M. Chappell, Webster, NY (US); Paul McConville, Webster, NY (US); James E. Williams, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 29 days.

(21) Appl. No.: 13/826,107

(22) Filed: Mar. 14, 2013

(65) Prior Publication Data

US 2014/0267482 A1 Sep. 18, 2014

(51) Int. Cl.
*B41J 2/01* (2006.01)
*B41J 11/00* (2006.01)

(52) U.S. Cl.
CPC ..... *B41J 11/0015* (2013.01)

(58) Field of Classification Search
USPC ..... 347/9, 12, 14, 15, 19, 6
See application file for complete search history.

(56) References Cited

U.S. PATENT DOCUMENTS

| | | | | |
|---|---|---|---|---|
| 6,934,500 | B2 | 8/2005 | Kowalski | |
| 7,515,305 | B2 * | 4/2009 | Mizes | 358/3.26 |
| 7,537,304 | B2 * | 5/2009 | Wu et al. | 347/19 |
| 7,543,911 | B2 * | 6/2009 | Mizes et al. | 347/41 |
| 7,623,254 | B2 * | 11/2009 | Eklund et al. | 358/1.14 |
| 7,798,587 | B2 * | 9/2010 | Mizes et al. | 347/8 |
| 7,866,782 | B2 * | 1/2011 | Borton | 347/19 |
| 7,995,940 | B2 * | 8/2011 | Hosier et al. | 399/49 |
| 8,317,291 | B2 * | 11/2012 | Mizes et al. | 347/19 |
| 8,376,516 | B2 * | 2/2013 | Viturro et al. | 347/43 |
| 8,485,621 | B2 * | 7/2013 | Fioravanti et al. | 347/7 |
| 8,506,038 | B2 * | 8/2013 | Mizes et al. | 347/19 |
| 2007/0146459 | A1 * | 6/2007 | Gault et al. | 347/103 |
| 2010/0271450 | A1 * | 10/2010 | Burress et al. | 347/103 |
| 2013/0337151 | A1 * | 12/2013 | Williams et al. | 427/8 |

OTHER PUBLICATIONS

Hunkeler AG, "Priming/Coating on Demand," published at least as early as Mar. 13, 2013 (4 pages).

* cited by examiner

*Primary Examiner* — Matthew Luu
*Assistant Examiner* — Lily Kemathe
(74) *Attorney, Agent, or Firm* — Maginot Moore & Beck LLP

(57) ABSTRACT

A module is configured to selectively apply release agent to a web having a sequence of printed imaged formed thereon by a printer. The module includes a plurality of dispensers arranged in a cross-process direction across the imaged web. The module detects positions of areas in the printed images and determines whether the amount of ink in the areas meet or exceed a predetermined density threshold. If an area meets or exceeds the threshold, a controller operates a dispenser to apply release agent to the area on the web as the area passes the dispenser. The controller operates the dispensers with reference to image data of the surface of the web.

9 Claims, 8 Drawing Sheets

DEVICE AND METHOD FOR ADDRESSABLE SPRAY-ON APPLICATION OF RELEASE AGENT TO CONTINUOUS FEED MEDIA

TECHNICAL FIELD

The device and method disclosed in this document relate to inkjet printers generally and, more particularly, to devices and methods for applying release agent to continuous feed media to facilitate finishing operations.

BACKGROUND

Inkjet printers have printheads that operate a plurality of inkjets that eject liquid ink onto an image receiving surface. The ink can be stored in reservoirs positioned within in the printer. Such ink may be aqueous, oil, solvent-based, or UV curable ink or an ink emulsion. Other inkjet printers receive ink in a solid form and then melt the solid ink to generate liquid ink for ejection onto the image receiving surface. In these solid ink printers, the solid ink can be in the form of pellets, ink sticks, granules or other shapes. Typically, an ink loader delivers solid ink pellets or ink sticks placed in the ink loader through a feed chute or channel to a melting device. A reservoir receives the melted ink and supplies the melted ink to one or more printheads. Other inkjet printers use gel ink. Gel inks are also heated to a predetermined temperature to alter the viscosity of the ink so the ink is suitable for ejection by a printhead.

A typical full width scan inkjet printer uses one or more printheads. Each printhead typically contains an array of individual nozzles for ejecting drops of ink across an open gap to an image receiving surface to form an image. The image receiving surface can be the surface of a continuous web of recording media, the surfaces of a series of media sheets, or the surface of an image receiving member, such as a rotating print drum or endless belt. Mechanical force is often used to fix images printed on a continuous web. A spreader nip produces the mechanical force with a pair of rollers configured to apply heat and pressure to the media web.

Continuous feed solid inkjet (SIJ) printers often print roll-to-roll, meaning the printers form images on the media web and then store the imaged media web on a roll for subsequent processing on offline finishing equipment. Such finishing equipment can include devices for, among other things, converting the web into individual sheets, perforating or punching holes into the web, or folding or creasing the web or the converted sheets.

Existing high-speed offline finishing operations, such as conversion into individual sheets, can cause image damage and/or ink offsetting to equipment surfaces. For existing continuous feed SIJ output, this image damage or ink offset can be attributed to insufficient amounts of release agent remaining on the imaged portions of the web. Moreover, the relatively long duration of time between imaging operations and offline finishing operations allows the imaged area to absorb what little release agent remains on its surface. The insufficient amount of release agent on the imaged area enables ink to offset from the web to surfaces of the finishing equipment that contact the imaged area, degrading the performance of the finishing equipment and the quality of the finished image. Systems exist for applying release agent to an imaged media web prior to performing further finishing operations. However, such systems apply release agent to the entire surface of the imaged area without consideration as to whether a given surface of the web is susceptible to ink offset. Consequently, these systems distribute more release agent than necessary since only those areas of a web susceptible to ink offset require treatment. Therefore, efficient application of release agent to imaged areas is desirable.

SUMMARY

A release agent applicator module has been developed for applying release agent to a web having a sequence of printed images on a first surface. The module includes a plurality of dispensers arranged in a cross-process direction across the web as the web moves in a process direction that is perpendicular to the cross-process direction, the process direction and the cross-process direction defining a plane that is parallel to the first surface of the web as the first surface of the web passes in front of the plurality of dispensers, each dispenser being configured for selective operation to dispense release agent onto a portion of the first surface of the web opposite the dispenser, and a controller operatively connected to each dispenser in the plurality of dispensers, the controller being configured to operate each dispenser with reference to a position of the first surface of the web and a content of each printed image in the sequence of printed images associated with the position of the first surface of the web.

A method for applying release agent to a web having a sequence of printed images on a first surface has been developed. The method includes moving the web in a process direction past a plurality of dispensers arranged across the web in a cross-process direction perpendicular to the process direction, the process direction and the cross-process direction defining a plane that is parallel to the first surface of the web as the first surface of the web passes in front of the plurality of dispensers, and selectively operating each dispenser in the plurality of dispensers to dispense release agent onto a portion of the first surface of the web opposite the dispenser, each dispenser being operated with reference to a position of the first surface of the web and a content of each printed image in the sequence of printed images.

BRIEF DESCRIPTION OF THE DRAWINGS

The foregoing aspects and other features of the device and method for addressable spray-on application of release agent to a continuous feed media are explained in the following description, taken in connection with the accompanying drawings.

DETAILED DESCRIPTION

Figure 1:
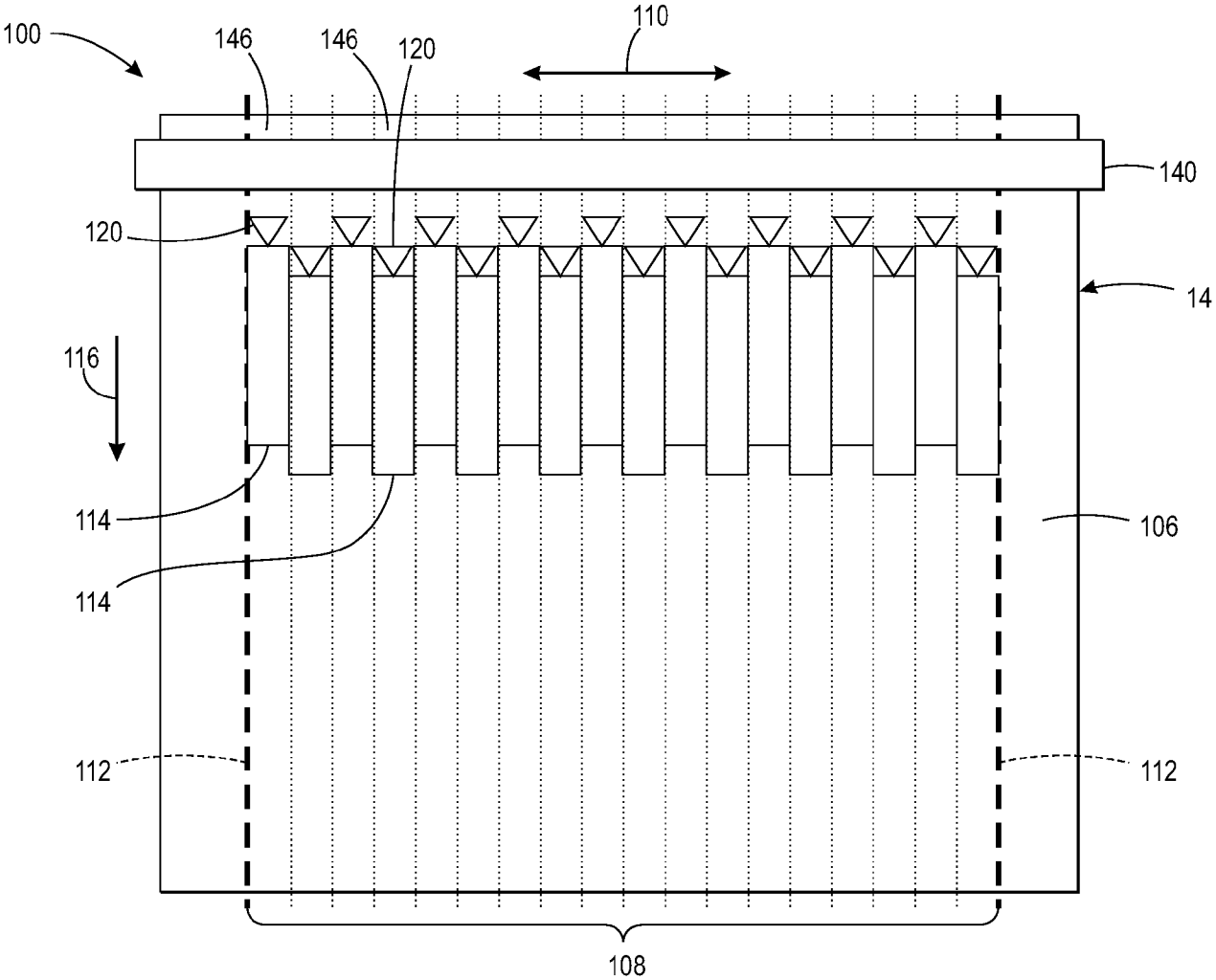
FIG. 1 is a schematic view of a release agent applicator module configured to implement a process for applying release agent to a web having a sequence of printed images on a first surface.

For a general understanding of the environment for the device and method disclosed herein as well as the details for the device and method, reference is made to the drawings. In the drawings, like reference numerals designate like elements. As used herein, the word "printer" encompasses any apparatus that produces images with colorants on media, such as digital copiers, bookmaking machines, facsimile machines, multi-function machines, and the like. As used herein, the term "process direction" refers to a direction of movement of a print medium, such as a continuous media web pulled from a roll of paper or other suitable print medium along a media path through a printer. The print medium moves past one or more printheads in a print zone within the printer to receive ink images and then pass other printer components, such as heaters, fusers, pressure rollers, and on-sheet imaging sensors, that are arranged along the media path. As used herein, the term "cross-process" direction refers to an axis that is perpendicular to the process direction along the surface of the print medium.

As used herein, the terms "finisher," "finishing equipment," "conversion equipment," or the like encompass any device or devices that perform processing or "finishing" of the print medium after ink images are formed on the medium. Such devices, for example, can separate the continuous media web into individual cut sheets, apply perforations to the print medium, and bend or crease the printed medium. As used herein, the term "inline" used in describing a type of finisher or finishing process refers to finishing operations performed either by the printer or by a device or devices upstream or downstream of the printer. In inline finishing, the finishing operations are performed close in time with the imaging operations and rewinding and storing of the print medium for later processing is often unnecessary. As used herein, the term "offline" used in describing a type of finisher or finishing process refers to finishing operations performed by a device or devices after an imaged continuous media web is rewound and transported to the finishing device or devices.

Figure 10:
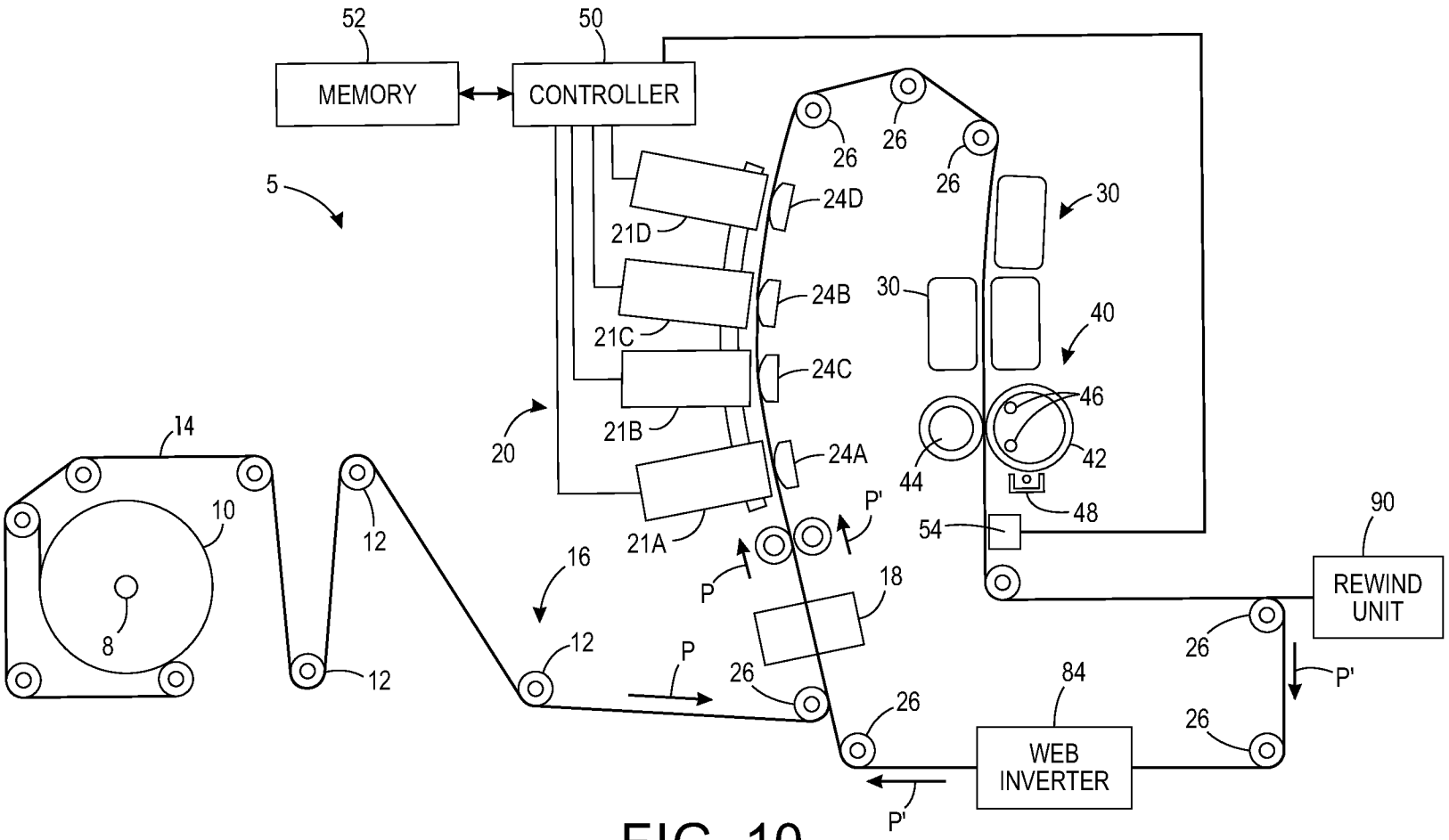
FIG. 10 PRIOR ART
FIG. 10 is a schematic view of a prior art inkjet printer that ejects ink onto a continuous web of media as the media moves past the printheads in the system.

FIG. 10 depicts a prior art inkjet printer 5. For the purposes of this disclosure, an inkjet printer employs one or more inkjet printheads to eject drops of ink onto a surface of an image receiving member, such as paper, another print medium, or an indirect member, such as a rotating image drum or belt. The printer 5 is configured to print ink images with a "phase-change ink," by which is meant an ink that is substantially solid at room temperature and that transitions to a liquid state when heated to a phase change ink melting temperature for ejecting onto the imaging receiving member surface. The phase change ink melting temperature is any temperature that is capable of melting solid phase change ink into a liquid. In one embodiment, the phase change ink melting temperature is approximately 70° C. to 140° C. As used herein, "liquid ink" refers to melted solid ink, heated gel ink, or other known forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink or any suitable substance, which includes one or more dyes or pigments and which is applied to the media. The colorant can be black or any other desired color, and some printer configurations apply a plurality of different colorants to the media. The media includes any of a variety of substrates, including plain paper, coated paper, glossy paper, or transparencies, among others, and the media can be available in sheets, rolls, or other physical formats.

The printer 5 is an example of a direct-to-web, continuous-media, phase-change inkjet printer that includes a media supply and handling system configured to supply a long (i.e., substantially continuous) web of media 14 of "substrate" (paper, plastic, or other printable material) from a media source, such as a spool of media 10 mounted on a web roller 8. The media web 14 includes a large number (e.g. thousands or tens of thousands) of individual pages separated into individual sheets with commercially available finishing devices after completion of the printing process.

For duplex operations, the web inverter 84 flips the media web 14 over to present a second side of the media to the print zone 20, before being taken up by the rewind unit 90. In duplex operation, the media source is approximately one-half of the width of the rollers over which the web travels so the web covers less than one-half of the surface of each roller 26 in the print zone 20. The inverter 84 flips and laterally displaces the media web 14 and the media web 14 subsequently travels over the other half of the surface of each roller 26 opposite the print zone 20, for printing and fixing of the reverse side of the media web 14. During first-side printing in the print zone 20, a first plurality of printheads in each of the printhead units 21A-21D forms a first side image on the media web 14 during a first pass through the print zone 20 and the spreader 40. The web inverter 84 inverts and re-routes the second side of the media web 14 through a second plurality of printheads in each of the printhead units 21A-21D during a second pass through the print zone 20 and the spreader 40. Thus, the second pass of the media web is downstream of the first pass through print zone 20, which includes both a first group of printheads that print on the first side the media web 14 and a second group of printheads that print on the second side of the media web 14. The rewind unit 90 is configured to wind the web onto a roller for removal of the media web from the printer and subsequent processing. Still referring to FIG. 10, the media web 14 is unwound from the source 10 as needed and a variety of motors, not shown, rotate one or more rollers 12 and 26 to propel the media web 14 in the process direction P. The media web 14 continues in the process direction P through the print zone 20 past a series of printhead units 21A, 21B, 21C, and 21D. Each of the printhead units 21A-21D effectively extends across the width of the media and includes one or more printheads that eject ink directly (i.e., without use of an intermediate or offset member) onto the media web 14. In the printer 5, each of the printheads ejects a single color of ink, one for each of the colors typically used in color printing; namely, cyan, magenta, yellow, and black (CMYK).

The controller 50 of the printer 5 receives velocity data from encoders mounted proximately to the rollers positioned on either side of the portion of the path opposite the four printheads to calculate the linear velocity and position of the web as the web moves past the printheads. The controller 50 uses the media web velocity data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50. The digital data for the images to be printed can be transmitted to the printer, generated by a scanner (not shown) that is a component of the printer, or otherwise generated and delivered to the printer.

Associated with each printhead unit is a backing member 24A-24D, typically in the form of a bar or roll, which is arranged substantially opposite the printhead on the back side of the media. Each backing member positions the media at a predetermined distance from the printhead opposite the backing member. As the partially-imaged media web 14 moves to receive inks of various colors from the printheads of the print zone 20, the printer 5 maintains the temperature of the media web 14 within a given range. The printheads in the printhead units 21A-21D eject ink at a temperature typically significantly higher than the temperature of the media web 14. Consequently, the ink heats the media, and temperature control devices maintain the media web temperature within a predetermined range. For example, the air temperature and air flow rate behind and in front of the media web 14 impacts the media temperature. Accordingly, in some embodiments, air blowers or fans are utilized to facilitate control of the media temperature. Thus, the printer 5 maintains the temperature of the media web 14 within an appropriate range for the jetting of all inks from the printheads of the print zone 20. Temperature sensors (not shown) in some embodiments are positioned along this portion of the media path to enable regulation of the media temperature.

Following the print zone 20 along the media path is a fixing assembly 40 that applies heat and/or pressure to the media to fix the images to the media. The fixing assembly includes any suitable device or apparatus for fixing images to the media including heated or unheated pressure rollers, radiant heaters, heat lamps, and the like. In the embodiment depicted in FIG. 10, the fixing assembly includes a "spreader" 40, which applies a predetermined pressure, and in some implementations, heat, to the media. The function of the spreader 40 is to flatten the individual ink droplets, strings of ink droplets, or lines of ink on web 14 and flatten the ink with pressure and, in some systems, heat. The spreader flattens the ink drops to fill spaces between adjacent drops and form uniform images on the media web 14. In addition to spreading the ink, the spreader 40 improves fixation of the ink image to the media web 14 by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web 14 to a temperature in a range from about 35° C. to about 80° C.

The spreader 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoise. A small amount of oil transfers from the station to the media web 14, with the printer 5 transferring approximately 1-10 mg per A4 sheet-sized portion of the media web 14. In one embodiment, the media is maintained at a high temperature as the media exits the print zone 20 to enable spreading of the ink. The printer 5 also includes an optical sensor 54 that is configured to generate image data of the media web 14 as discussed in more detail below.

In printer 5, the controller 50 is operatively connected to various subsystems and components to regulate and control operation of the printer 5. The controller 50 is implemented with general or specialized programmable processors that execute programmed instructions. The instructions and data required to perform the programmed functions are stored in a memory 52 that is associated with the controller 50. The memory 52 stores programmed instructions for the controller 50. The processors, their memories, and interface circuitry configure the controllers and/or print zone to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 50 is operatively connected to the printheads in the printhead units 21A-21D. The controller 50 generates electrical firing signals to operate the individual inkjets in the printhead units 21A-21D to eject ink drops that form printed images on the media web 14.

After simplex, or optional duplex, printing operations, the media web 14 is wound onto the roller of the rewind unit 90 for removal from the printer 5 and subsequent processing. Such processing often includes conversion of the printed media web into individual cut sheets, sometimes called "sheeting," to enable final distribution of the printed substrate. Printing systems that use aqueous, emulsified, and other types of ink can produce images on media that experience ink offsetting during offline conversion, but the offsetting occurs for reasons other than an inadequate amount of release agent since these systems do not use release agent in the printing process. Existing continuous feed SIJ systems, however, perform inadequately with offline conversion because an insufficient amount of release agent remains on the surface of the image after the ink spreading operation. During conversion of existing continuous feed SIJ output, for example, insufficient amounts of residual release agent on the surface of the image can result in ink offsetting to surfaces of the converting equipment, resulting in degraded performance of the finishing equipment and poor quality of the finished image. The relatively long duration of time between printing operations and offline finishing operations further exacerbates this degraded performance and poor image quality.

Figure 2:
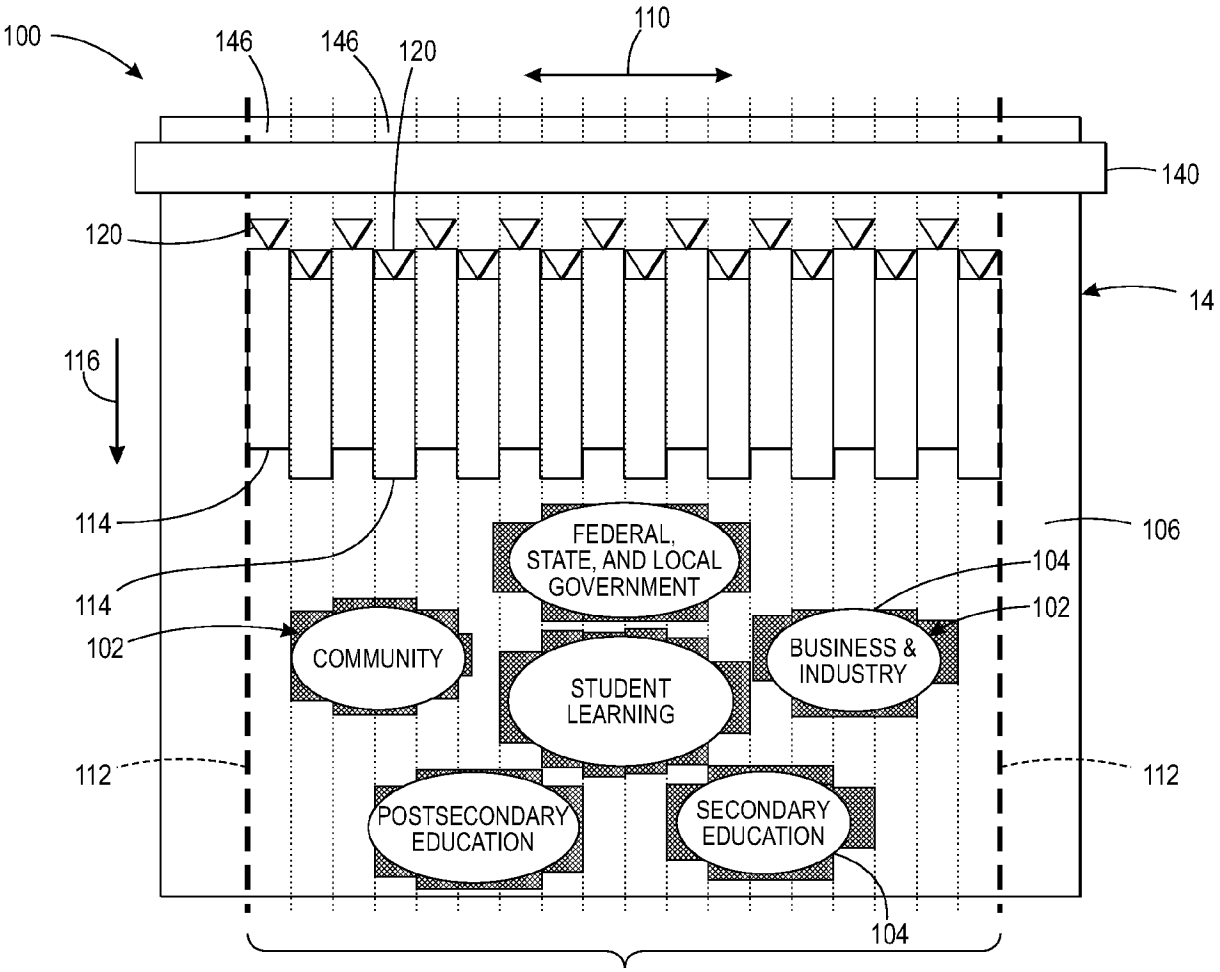
FIG. 2 is a schematic view of the release agent applicator module of FIG. 1 having implemented the process and selectively applied release agent to printed images in the sequence of printed images on the first surface.
Figure 3:
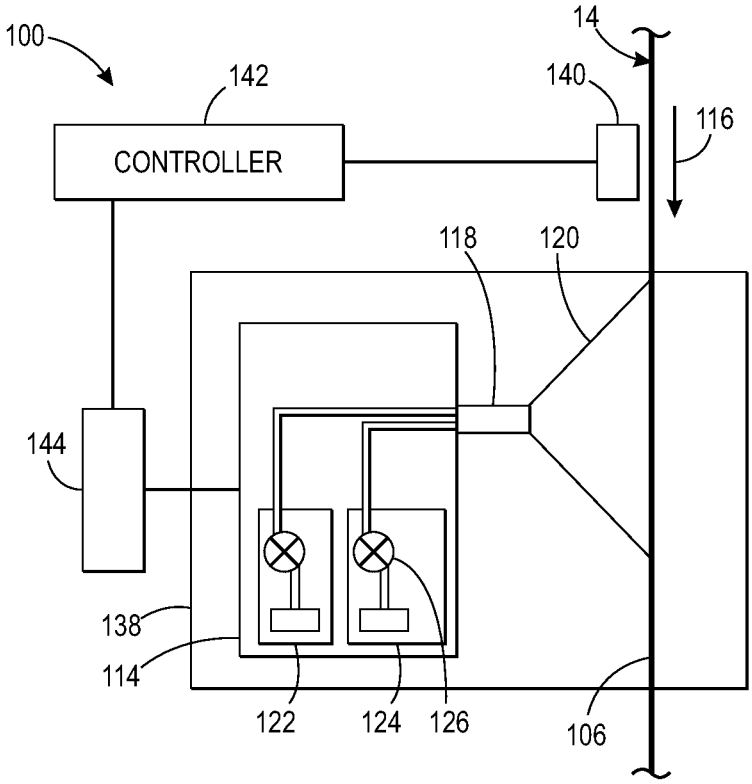
FIG. 3 is a block diagram of a controller associated with the release agent applicator module of FIG. 1 with the controller having operative connections to an optical sensor and a solenoid valve associated with a dispenser of the release agent applicator module.

FIGS. 1-3 depict a release agent applicator module 100 configured to implement a process for applying release agent to the simplex-imaged web of the printer 5 before finishing operations are performed on the web. The web 14 has a sequence of printed images 102 formed on a first surface 106 of the web 14 during simplex printing operations. The sequence of printed images 102 are formed within a print area 108 on the first surface 106. The dashed lines 112 delineate the boundaries of this area in the cross-process direction 110 (FIG. 1 and FIG. 2). The release agent applicator module can be beneficial in the offline conversion of media that has been printed with inks other than phase change ink. Such a module, however, is especially beneficial in the treatment of media bearing images formed with phase change ink because release agent on the surface of the phase change ink reduces the adherence of offline equipment to the solidified phase change ink on the media without adversely impacting the ink as may occur with other types of ink.

The release agent applicator module 100 includes a plurality of dispensers 114 arranged in the cross-process direction 110 across the web 14. A finisher transport system (not shown) moves the simplex-imaged web 14 past the release agent applicator module 100 in a process direction 116 that is perpendicular to the cross-process direction 110. The process direction 116 and the cross-process direction 110 define a plane that is approximately parallel to the first surface 106 of the web 14 as the first surface 106 of the web 14 passes in front of the plurality of dispensers 114. Each dispenser 114 is configured to dispense the release agent selectively onto a portion of the first surface 106 of the web 14 opposite the dispenser 114.

Figure 4:
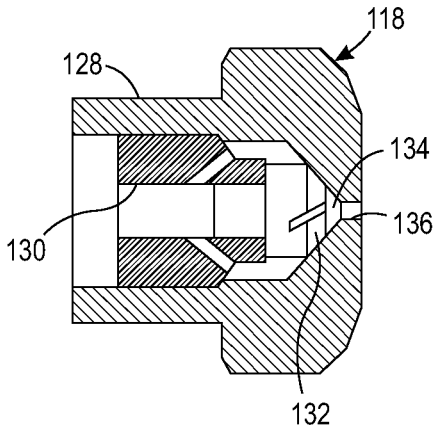
FIG. 4 is a schematic view of one embodiment of a spray nozzle used to atomize the release agent before the release agent is applied to the web.

Referring now to FIGS. 3 and 4, each dispenser 114 is configured to atomize the release agent as the release agent is dispensed onto the first surface 106 of the web 14. The dispensers 114 each include a nozzle 118 that mixes compressed air and the release agent to atomize the release agent into a spray or mist 120 directed toward the passing web 14. The compressed air is filtered and drawn from the area surrounding the module 100 and then supplied to the nozzle 118 from an air source 122 shared by all of the dispensers 114. In some embodiments, the release agent is stored in a common reservoir 124 within the module 100 and delivered to the nozzle 118 via a pump or metering device 126. In other embodiments, the compressed air from the air source 122 transports the release agent from the common reservoir 124 to the nozzle 118. The common reservoir 124 is configured to be replenished periodically when the fluid level drops below a predetermined amount.

The nozzle 118 of each dispenser 114 has a body 128 that defines a plurality of fluid chambers within the nozzle 118. The compressed air and the release agent are delivered from their respective sources 122, 124 to an inlet orifice 130 of the nozzle 118. The compressed air and the release agent then enter a swirl core 132 and a swirl chamber 134 where the release agent is atomized. The atomized release agent exits the nozzle 118 at an outlet orifice opening 136, which directs the release agent towards the web 14. In some embodiments, characteristics of the outlet orifice 136, such as orifice area, shape, or axial taper, can be varied to adjust the direction or shape of the release agent spray 120.

In one embodiment, the release agent is a silicon-based oil having a small amount of functional amine, for example, 0.5 percent amine. One example of such an oil is CopyAid 270. The chemical composition of CopyAid 270 is described as a Polydimethylsiloxane+Polydimethylsiloxane with aminoalkyl groups. Although CopyAid 270 is approximately 70-centistoke viscosity, other types of oils, particularly ones with lower viscosities, can be used for the same purpose. In the embodiment using CopyAid 270, the oil is applied at a rate of 4-50 mg per A4 sheet-sized portion of the web 14 with a minimum rate of approximately 4-8 mg per A4 (ink solid fill).

Referring to FIG. 3, an enclosure member 138, such as a housing, surrounds the plurality of dispensers 114 and closely seals with the passing web 14 to collect release agent that does not land on the first surface 106 of the web 14. In some embodiments, the enclosure member 138 includes one or more slits at a boundary edge and a vacuum system including a pump (not shown), for example, is coupled to the slits to generate a vacuum at the boundaries of the enclosure member 138 to assist in the collection of the atomized release agent exiting away from the web. Exhaust from the vacuum system is filtered such that there is no airborne egress of the collected release agent from the module 100.

Referring again to FIGS. 1-3, the module 100 includes an optical sensor 140 that is configured to generate image data of the web as the web passes the sensor. The optical sensor 140 includes an array of optical detectors mounted to a bar or other longitudinal structure that extends at least across the width of the print area 108 on the first surface 106 of the web 14. The optical detectors are configured in association in one or more light sources that direct light towards the first surface 106 of the web 14. The optical detectors receive the light generated by the light sources after the light is reflected from the web 14. The magnitude of the electrical signals generated by an optical detector correspond to an amount of reflected light received by the detectors from the bare surface of the web 14 or ink markings formed on the web 14. Analog/digital converters convert the magnitudes of the electrical signals generated by the optical detectors to digital values.

The module 100 further includes a controller 142 operatively connected to the optical sensor 140 and to each dispenser in the plurality of dispensers 114 via a solenoid valve 144. The controller 142 is implemented with general or specialized programmable processors that execute programmed instructions. The instructions and data required to perform the programmed functions are stored in a memory that is associated with the controller 142. In response to the controller 142 executing the programmed instructions, the controller identifies positions and boundaries of areas on the web that are covered by an amount of ink that equals or exceeds a predetermined density threshold. The controller operates each dispenser 114 with reference to the positions and boundaries identified on the first surface 106 of the web 14. If the controller identifies an area on the web as meeting or exceeding the predetermined density threshold, the controller 142 sends a signal to the solenoid valve 144 to operate a dispenser 114 as the identified area passes the dispenser. The controller operates the solenoid valve 144 of the dispenser to dispense release agent onto the first surface 106 of the web 14 opposite the dispenser 114 as the identified area passes the dispenser. The association of each dispenser 114 with a discrete section 146 across the first surface 106 of the web 14 enables the module 100 to apply release agent only to those sections 146 of the first surface 106 of the web 14 containing portions of the printed images 104 that meet or exceed the predetermined threshold. As discussed below, the selective addressability of the release agent has positive implications for printing systems that employ offline finishing operations.

Figure 5:
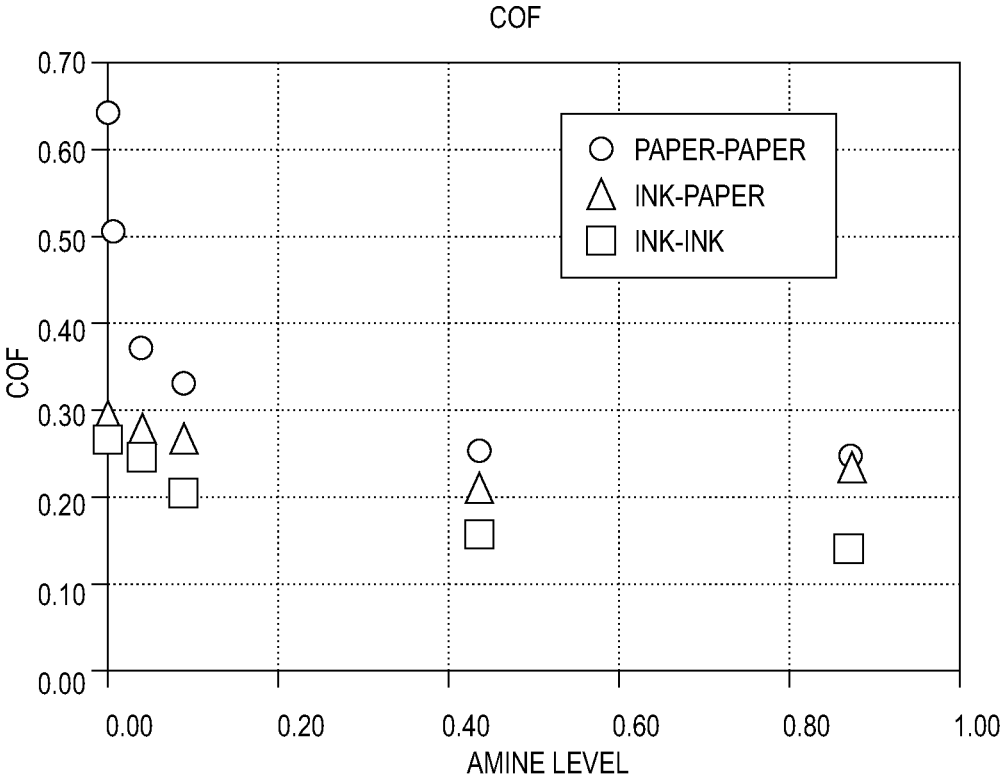
FIG. 5 is a graph representing how the amount and position of release agent effects the coefficient of friction between different types of web materials.

FIG. 5 shows the effect release agent has on the coefficient of friction (COF) of the web when two "sheeted" output sheets are in contact with each other under various conditions. In general, the COF of the media undergoing finishing operations is preferred to be as high as possible, and at least above a minimum level of approximately 0.3. As evident in FIG. 5, release agent applied to the inked portion of the web has almost no impact on the COF between the output sheets. Release agent applied to the non-imaged part of the web, however, significantly reduces the COF between the sheets. This reduction in paper-paper COF can be quite significant depending on the amine content of the release agent. In particular, the COF for paper is reduced from 0.7 to less than 0.3 when using "nominal" CopyAid 270 oil. FIG. 5 illustrates that many of the offline finishing devices used in conjunction with commercial continuous-media, phase-change inkjet printers are sensitive to the COF of the printed output. Consequently, applying release agent only to those areas carrying ink is an important improvement in finished web processing.

Figure 6:
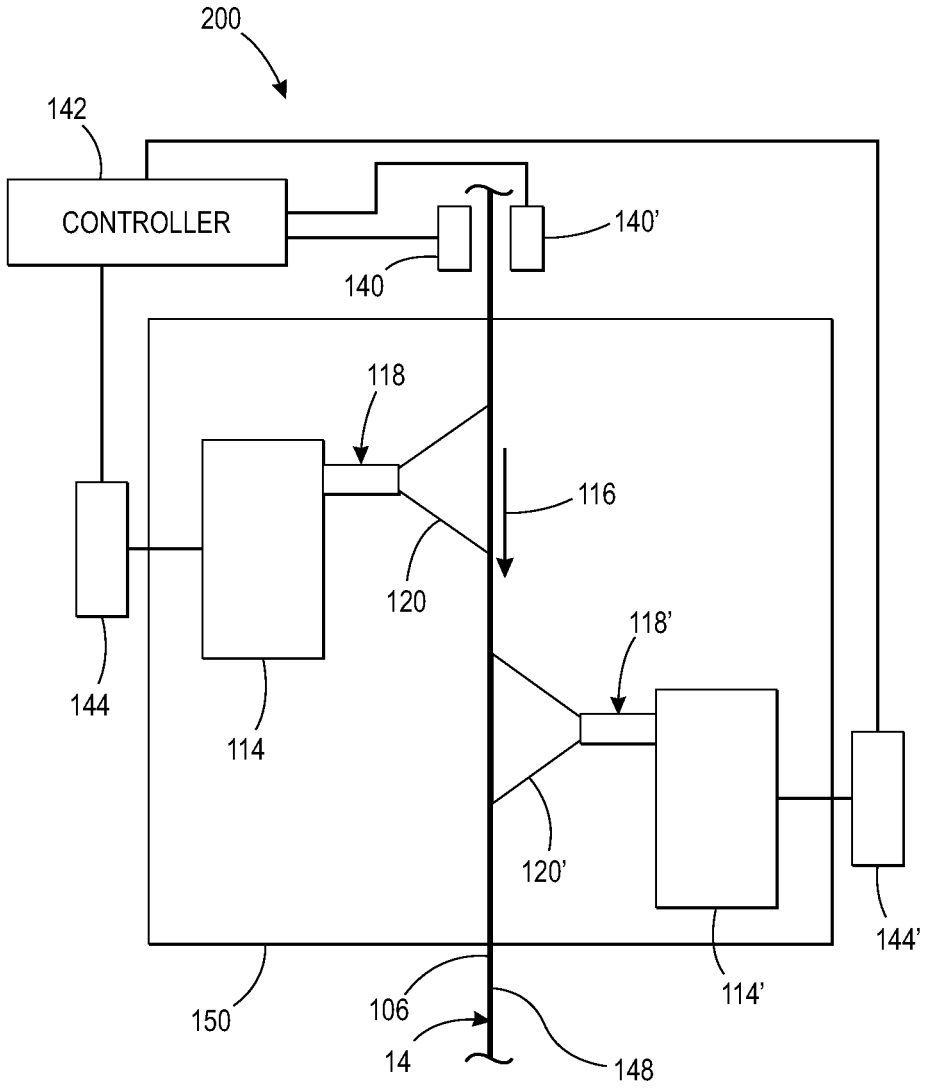
FIG. 6 is a schematic view of a release agent application module configured to implement a process for applying release agent to a web having sequences of printed images on first and second surfaces.

FIG. 6 shows a release agent applicator module 200 configured to implement a process for applying release agent to the duplex-imaged web of the printer 5 before finishing operations are performed on the web. In this embodiment, the web 14 has the sequence of printed images (not shown) formed on the first surface 106 of the web 14 during simplex printing and has a second sequence of printed images (not shown) formed on a second surface 148 of the web 14 during duplex printing. The second surface 148 of the web 14 is located opposite the first surface 106 and the second sequence of printed images is formed within a print area (not shown) on the second surface that closely approximates the position of the print area 108 of the first surface 106.

For the selective application of the release agent onto the first surface 106 of the web 14, the release agent applicator module 200 includes the plurality of dispensers 114, the optical sensor 140, and the controller 142 as described above with reference to FIGS. 1-4. The release agent applicator module 200 further includes a second optical sensor 140' and a second plurality of dispensers 114' for the selective application of release agent onto the second surface 148 of the web 14. The second plurality of dispensers 114' are substantially identical to the structural and operational configuration of the plurality of dispensers 114, but, as depicted in FIG. 6, the second dispensers 114' are positioned to dispense release agent onto the second surface 148 of the web 14.

The finisher transport system (not shown) moves the duplex-imaged web 14 in the process direction 116 past the plurality of dispensers 114 and the second plurality of dispensers 114'. The process direction 116 and the cross-process direction 110 define a plane that is approximately parallel to the second surface 148 of the web 14 as the second surface 148 of the web 14 passes in front of the second plurality of dispensers 114'. Each second dispenser 114' is configured to dispense the release agent onto a portion of the second surface 148 of the web 14 opposite the second dispenser 114' in response to a signal from the controller operating the dispenser. Each dispenser in the second plurality of dispensers 114' is configured to mix compressed air and release agent to atomize the release agent into an atomized spray or mist 120' directed toward the passing web 14 as noted above with reference to the first plurality of dispensers.

An enclosure member 150 surrounds the plurality of dispensers 114 and the second plurality of dispensers 114' and closely seals with the passing web 14 to collect release agent that does not land on either or both of the first and second surfaces 106, 148 of the web 14. In some embodiments a vacuum system similar to the one described above generates a vacuum within the enclosure member 150 to collect atomized release agent not landing on the web. Exhaust from the vacuum system is filtered to prevent airborne egress of the collected release agent from the release agent applicator module 200.

The second optical sensor 140' is configured in a manner similar to the optical sensor 140 described above. The controller 142 analyzes the digital image data generated with reference to the image data from sensor 140' and operates each dispenser in the second plurality of dispensers 114' selectively with reference to that data. The controller 142 selectively generates signals to operate solenoid valves in the dispensers of the second plurality of dispensers as described above with regard to the first plurality of dispensers.

Although the release agent applicator module 200 has been described with reference to the application of release agent to duplex-imaged webs, the module 200 can similarly be operated to selectively apply release agent to simplex-imaged webs. In this embodiment, only the dispensers opposite the surface of the web containing printed images are selectively operated by the controller to apply release agent. The dispensers opposite the non-imaged or blank surface of the simplex-imaged web are not operated to dispense release agent. In some embodiments, the dispensers opposite the blank surface are placed in an IDLE or OFF state and are incapable of receiving control signals from the controller while in this state. In other embodiments, the dispensers are enabled and capable of dispensing release agent; however, the controller does not provide the activation signal to operate the dispensers.

Figure 7:
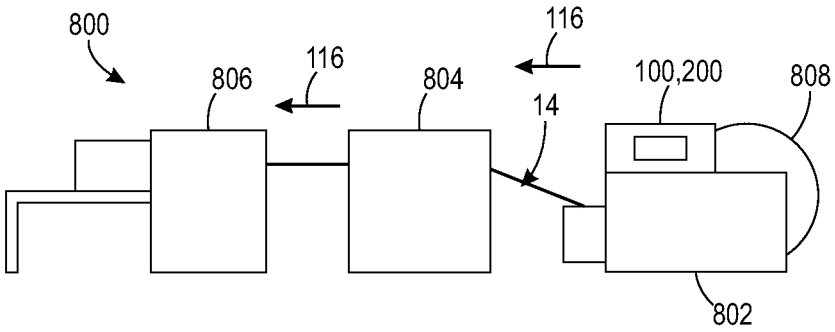
FIGS. 7 and 8 are block diagrams of the release agent applicator module of either FIG. 1 or FIG. 6 integrated with a finishing system.
Figure 8:
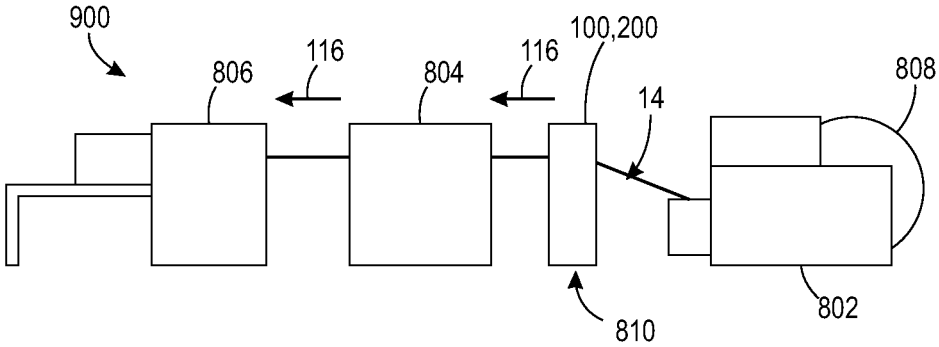

FIGS. 7 and 8 depict the release agent applicator module 100, 200 integrated with an offline finishing system 800, 900. The finishing system 800, 900 can include any number and type of finishing devices to process the simplex or duplex-imaged web. In the embodiments of FIGS. 7 and 8, the finishing system 800, 900 is shown with an unwind module 802, a punching and perforating module 804, and a folding module 806. The unwind module 802 is configured to receive a roller 808 removed from the rewind unit 90 and to feed the imaged web 14 stored on the roller 808 to the other fishing devices at a predetermined speed and tension. The punching and perforating module 804 is configured to generate longitudinal and transverse perforations along the web 14 and to punch file holes therethrough. The folding module 806 receives the pre-perforated web 14 from the punching and perforating module 804 and is configured to fold, separate, and stack the now sheeted web 14 for subsequent distribution.

Each of the modules 802, 804, and 806 includes a transport system (not shown) including various rollers, hardware, and the like to move the web 14 through the modules. As such, ink offsetting/smearing can occur in the modules 802, 804, and 806 if any surfaces of their respective transport systems come into contact with printed surfaces on the web 14 having insufficient amounts of release agent thereon. To mitigate ink offsetting/smearing during offline finishing operations, the release agent applicator module 100, 200 is integrated with the finishing system 800, 900 to selectively apply release agent to the printed surfaces of the web 14 early in the finishing process. Although the finishing system 800, 900 has been described with reference to specific finishing devices, other combinations of finishing devices can be implemented. For example, the finishing system 800, 900 can also include, among others, cross cutting modules, web inspection modules, buffering modules, folding/merging modules, and/or stacking modules.

FIG. 7 depicts the release agent applicator module 100, 200 integrated with the unwind module 802. The applicator module 100, 200 is mounted directly into or on the unwind module 802 such that the selectively dispensed release agent protects the transport system of the unwind module 802 as well as the transport systems of any downstream finishing devices, for example, the punching and perforating module 804 and the folding module 806. In this embodiment, virtually every surface of the finishing system 800 that interacts with the inked web 14 contacts web surfaces having sufficient amounts of release agent applied thereon.

FIG. 8 depicts the release agent applicator module 100, 200 integrated with a standalone module 810 positioned between the unwind module 802 and the remaining finishing equipment. This embodiment offers an alternative to the configuration of FIG. 7 if the hardware of the unwind module 802 hinders the incorporation of the applicator module 100, 200 with the unwind module 802. While the release agent applicator module 100, 200 in this embodiment does not apply release agent to the web 14 before entering the unwind module 802, release agent is selectively applied to the web 14 prior to entering the finishing equipment downstream of the standalone module 810.

Figure 9:
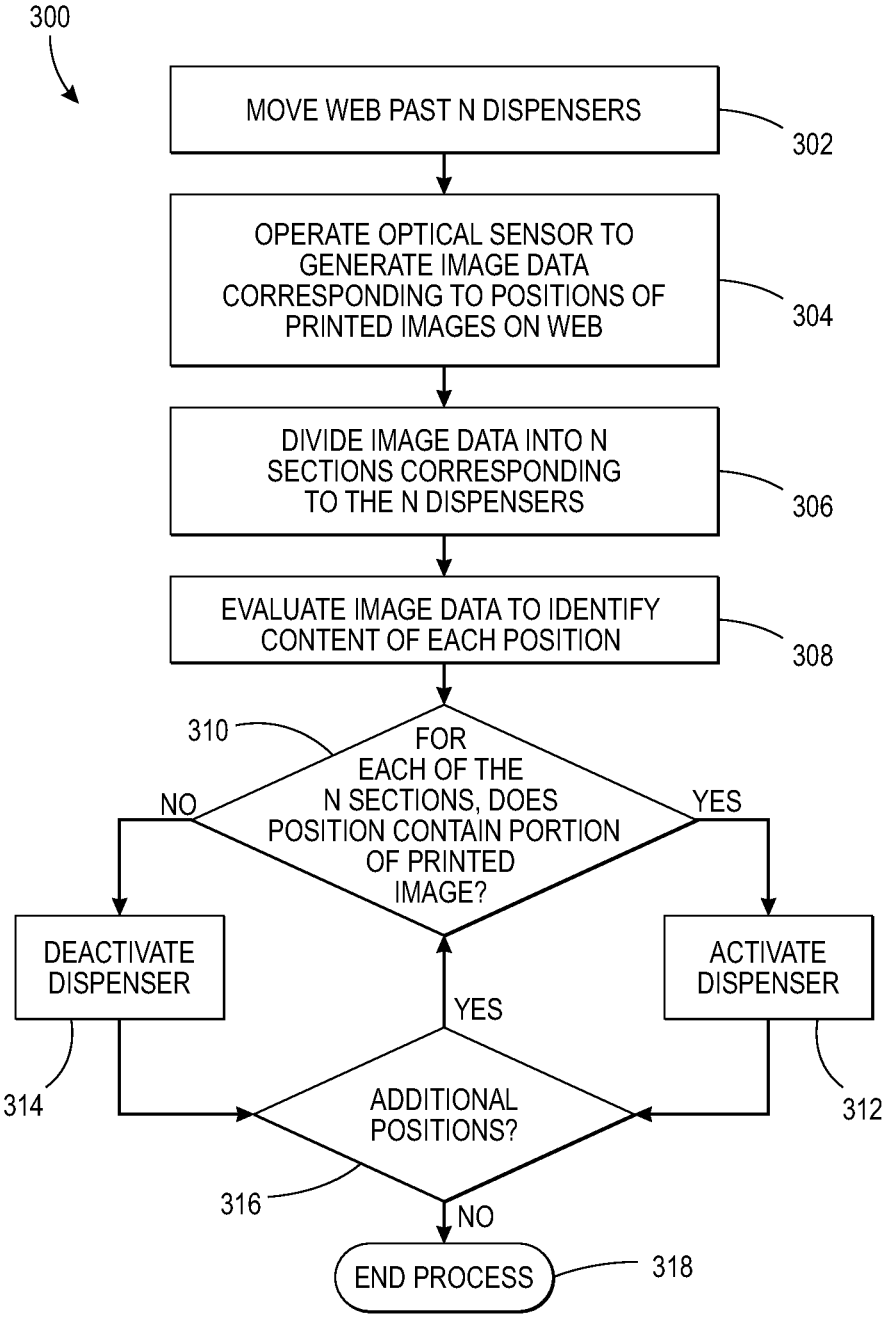
FIG. 9 is a flow diagram of a process for selectively applying release agent to a web having a sequence of printed images on a first surface.

A flow diagram of a process 300 for selectively applying release agent to a web having a sequence of printed images on a first surface 106 is shown in FIG. 9. The controller is configured to execute programmed instructions stored in a memory operatively connected to the controller to implement the process 300. In the discussion below, a reference to the process performing a function or action refers to the controller executing programmed instructions stored in the memory to operate one or more components to perform the function or action. The process 300 is described with reference to the release agent applicator module 100, 200 shown in FIGS. 1-4 and 7.

The process 300 begins by moving the imaged web 14 in the process direction 116 past the plurality of dispensers 114 (block 302). As the web 14 moves in the process direction 116, the optical sensor 140 is operated to generate image data of the first surface 106 of the web 14 (block 304). The process 300 divides the image data into respective sections that correspond to each dispenser in the plurality of dispensers 114 (block 306). The sections of image data correspond to the discrete areas 146 across the web 14 in the cross-process direction 110 onto which the dispensers 114 are configured to apply release agent. Accordingly, the number of dispensers in the plurality of dispensers 114 determines the number of sections into which the image data is divided.

The process 300 evaluates the image data generated by the optical sensor 140 to identify the positions and boundaries of the printed images 104 in the sequence of printed images 102 (block 308). In particular, the process 300 analyzes the image data to identify areas in which the density of the ink meets or exceeds a predetermined density threshold. The process 300 then determines whether the identified areas are positioned within the corresponding area 146 on the web 14 and, therefore, are capable of receiving release agent from the dispenser 114 associated with the area (block 310).

For each image area associated with an area 146, the process 300 activates the dispenser 114 associated with the area to dispense the release agent onto the surface 106 of the web 14 opposite the dispenser 114 (block 312). In operation, the controller 142 sends a signal to the solenoid valve 144 associated with the dispenser 114 to operate the dispenser 114 to dispense the release agent. The process 300 periodically evaluates the digital image data and updates the signal to the solenoid valve 144. For example, in one embodiment, the solenoid valve 144 is configured to operate its associated dispenser 114 for a predetermined duration of time upon receipt of a signal. In this embodiment, if the solenoid valve 144 does not receive a new signal indicating the presence of printed images 104 opposite the dispenser 114, the solenoid valve 144 disables the dispenser 114 to prevent release agent from being dispensed. In another embodiment, the solenoid valve 144, upon receipt of a signal indicating the presence of printed images 104 opposite the dispenser 114, is configured to continuously operate the dispenser 114 until a deactivation signal is provided. In this embodiment, the process 300 deactivates the dispenser 114 associated with an area in response to no image area being identified for the area opposite a dispenser (block 314).

After a dispenser is either activated (block 312) or deactivated (block 314), the process 300 determines whether another portion the web 14 will pass the plurality of dispensers 114 (block 316). If the web is continuing, the process 300 continues to determine for another area contains a printed image 104 (block 310). If no additional areas are identified, the process 300 ends (block 318). For selective application of release agent to a duplex imaged web, movement of web 14 in the process direction 116 (block 302) moves the web 14 past both the plurality of dispensers 114 and the second plurality of dispensers 114' (FIG. 6). The process 300 operates the second optical sensor 140' and the second plurality of dispensers 114' according to Blocks 304-316 to selectively apply release agent to the print images on the second surface 148 of the web 14.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A release agent applicator for applying release agent to a web having a sequence of printed images on a first surface comprising:

a plurality of dispensers arranged in a cross-process direction across the web as the web moves in a process direction that is perpendicular to the cross-process direction, the process direction and the cross-process direction defining a plane that is parallel to the first surface of the web as the first surface of the web passes in front of the plurality of dispensers, each dispenser being configured with a source of compressed air and for selective operation to atomize and dispense a silicon-based oil onto a portion of the first surface of the web opposite the dispenser;

an optical sensor configured to generate image data corresponding to the first surface of the web as the web moves in the process direction; and a controller operatively connected to the optical sensor and each dispenser in the plurality of dispensers, the controller being configured to receive the image data from the optical sensor and identify positions and boundaries of areas having an ink density that meets or exceeds a predetermined density threshold as the web moves in the process direction, the positions and boundaries being identified with reference to the image data received from the optical sensor, and to operate each dispenser with reference to a position of the first surface of the web and a content of each printed image in the sequence of printed images associated with the position of the first surface of the web to dispense an amount of silicon-based oil with reference to the content of each printed image.

2. The release agent applicator of claim 1, the controller being further configured to:

operate dispensers in the plurality of dispensers with reference to the areas for which positions and boundaries have been identified passing the dispensers.

3. The release agent applicator of claim 1 further comprising:

a second plurality of dispensers arranged in the cross-process direction across the web as the web moves in a process direction that is perpendicular to the cross-process direction with a second sequence of printed images on a second surface of the web, which is opposite the first surface of the web, the process direction and the cross-process direction defining a plane that is parallel to the second surface of the web as the second surface of the web passes in front of the second plurality of dispensers, each dispenser in the second plurality of dispensers being configured for selective operation to dispense silicon-based oil onto a portion of the second surface of the web opposite the dispenser; and the controller is operatively connected to each dispenser in the second plurality of dispensers, the controller being configured to operate each dispenser in the second plurality of dispensers with reference to a position of the second surface of the web and a content of each printed image in the second sequence of printed images.

4. The release agent applicator of claim 3 further comprising:

a second optical sensor configured to generate image data corresponding to the second surface of the web as the web moves in the process direction; and the controller being operatively connected to the second optical sensor to receive the image data from the second optical sensor and identify positions and boundaries of areas having an ink density that meets or exceeds the predetermined density threshold as the web moves in the process direction.

5. The release agent applicator of claim 4, the controller being further configured to:

operate dispensers in the second plurality of dispensers with reference to the areas on the second surface for which positions and boundaries have been identified passing the dispensers.

6. The release agent applicator of claim 1, each dispenser in the plurality of dispensers further comprising:

a solenoid valve operatively connected to the controller, the solenoid valve configured to receive a signal from the controller to enable the dispenser associated with the solenoid valve to dispense silicon-based oil onto the portion of the first surface of the web opposite the dispenser.

7. The release agent applicator of claim 1 further comprising:

a member surrounding the plurality of dispensers to collect silicon-based oil that does not land on the first surface of the web.

8. The release agent applicator of claim 7 further comprising:

a pump configured to generate a vacuum within the member to collect the silicon-based oil that does not land on the first surface of the web.

9. The release agent applicator of claim 1 wherein the sequence of printed images on the first surface of the web are formed with phase-change ink.

* * * * *